US006546861B2

(12) United States Patent
Manser

(10) Patent No.: US 6,546,861 B2
(45) Date of Patent: Apr. 15, 2003

(54) PRINTING PRESS SCRAPING BLADE

(75) Inventor: John W. Manser, Elgin, IL (US)

(73) Assignee: Goss Graphic Systems, Inc., Westmont, IL (US)

( * ) Notice: Subject to any disclaimer, the term of this patent is extended or adjusted under 35 U.S.C. 154(b) by 0 days.

(21) Appl. No.: 09/918,259

(22) Filed: Jul. 30, 2001

(65) Prior Publication Data

US 2003/0019379 A1 Jan. 30, 2003

(51) Int. Cl.[7] ..... B41F 35/04

(52) U.S. Cl. ..... 101/169; 101/157; 118/261; 15/256.51

(58) Field of Search ..... 101/155, 157, 101/161, 167, 169, 170, 350.5, 365, 425; 118/261; 15/256.51, 256.52

(56) References Cited

U.S. PATENT DOCUMENTS

| | | | | | |
|---|---|---|---|---|---|
| 2,148,456 | A | | 2/1939 | Grossarth | 101/169 |
| 2,313,830 | A | | 3/1943 | Lundbye | 148/602 |
| 2,361,554 | A | | 10/1944 | Lundbye | 148/530 |
| 3,848,992 | A | * | 11/1974 | Smith | 100/174 |
| 3,848,993 | A | * | 11/1974 | Hasiotis | 100/174 |
| 4,060,031 | A | | 11/1977 | Philipp | 101/163 |
| 4,089,264 | A | * | 5/1978 | Jeschke et al. | 101/169 |
| 4,184,429 | A | | 1/1980 | Widmer | 101/169 |
| 4,254,709 | A | * | 3/1981 | Arnolds | 101/169 |
| 4,373,445 | A | | 2/1983 | Köbler | 101/365 |
| 4,378,736 | A | | 4/1983 | Sarda | 101/365 |
| 4,393,775 | A | | 7/1983 | Cappel et al. | 101/365 |
| 4,538,518 | A | * | 9/1985 | Dahlgren | 101/169 |
| 4,676,160 | A | | 6/1987 | Linska | 101/365 |
| 5,046,414 | A | | 9/1991 | Oozeki | 101/123 |
| 5,152,221 | A | | 10/1992 | Weeks | 101/157 |
| 5,524,540 | A | | 6/1996 | Van Denend | 101/363 |
| 5,638,751 | A | | 6/1997 | Daetwyler et al. | 101/169 |
| 5,806,427 | A | | 9/1998 | Niemiro et al. | |
| 5,826,296 | A | | 10/1998 | Steven | 15/256.51 |
| 5,895,150 | A | * | 4/1999 | Watabe et al. | 118/261 |
| 5,983,798 | A | | 11/1999 | Iijima et al. | 101/365 |
| 6,112,661 | A | | 9/2000 | Albiez | 101/365 |
| 6,202,252 | B1 | * | 3/2001 | Harrisson | 101/169 |
| 6,318,259 | B1 | * | 11/2001 | Chou et al. | 101/350.5 |
| 6,360,660 | B1 | * | 3/2002 | Allison, Jr. | 101/169 |
| 6,431,066 | B1 | * | 8/2002 | Perez et al. | 101/350.6 |

FOREIGN PATENT DOCUMENTS

WO PCT - WO 86/07309 12/1986

OTHER PUBLICATIONS

International Search Report; PCT/US02/24062 issued on Nov. 12, 2002.

* cited by examiner

*Primary Examiner*—Stephen R. Funk
*Assistant Examiner*—Dave A. Ghatt
(74) *Attorney, Agent, or Firm*—Marshall, Gerstein & Borun

(57) ABSTRACT

A printing press ink scraping blade is disclosed. The ink scraping blade is of a unitary construction and includes a working end as well as a mounting end. The working end is preferably substantially thicker than the mounting end to provide substantially more material at the working end. As the scraping blade engages a scraping roller of a printing press, the blade is exposed to abrasive action and the additional material provided increases the serviceable life of the blade. To ensure that the blade maintains sufficient flexibility and deflection characteristics, the remainder or mounting end of the blade, is of a substantially reduced thickness. The blade may be manufactured from spring steel to further enhance flexibility.

28 Claims, 3 Drawing Sheets

PRINTING PRESS SCRAPING BLADE

FIELD OF THE INVENTION

The invention generally relates to printing presses and, more particularly, relates to scraping or doctor blades for use with printing presses.

BACKGROUND OF THE INVENTION

Keyless printing presses commonly employ a series of rollers, referred to as an ink train, to direct ink from an ink source to a cylinder which applies the ink to a moving web of paper. The series of rollers comprising the ink train, and communicating the ink to the web of paper, accurately meter the ink to ensure that the appropriate amount of ink is transferred to result in an accurate and aesthetically pleasing appearance in the printed text or image.

One additional device used to meter the amount of ink transferred to the paper is referred to as a scraping or doctor blade. The blade includes a tip in direct contact with a scraper roller of the ink train to scrape excess ink from the scraper roller. The removed ink is typically directed via gravity into an ink module provided directly below the blade. The removed ink is then recycled back to an applicator device at the beginning of the ink train for ultimate re-application to the web.

One difficulty associated with known scraping blades is that both the ink and the roller against which the blade scrapes are abrasive. The material from which the blade is made therefore tends to wear, resulting in a relatively short serviceable life, sometimes as short as forty hours of use. This in turn results in longer downtime for the press, and ultimately in added expense to the operator.

An additional factor complicating the situation is that the blade must be deflectable or deformable to ensure the blade maintains contact with the roller throughout its operation. The blade is typically mounted at an angle to the circumferential surface of the ink roller and is mechanically or otherwise biased toward the roller to ensure such contact. In light of such a requirement, the blade typically cannot be manufactured from extremely high hardness or wear resistance materials as such materials typically do not afford the necessary deflection characteristics needed in the blade.

Moreover, with known blades the material of the blade can be worn away so quickly, that the air cylinder or similar device biasing the blade toward the scraping roller can push the blade to such a steep angle with respect to the roller circumference that the blade tends to plow the ink, rather than remove the ink.

The prior art has provided a number of different types of doctor blades. For example, U.S. Pat. No. 5,638,751, discloses a doctor blade of a stepped construction. More specifically, the doctor blade includes a thin tip portion which transitions into a thicker doctor blade portion, which in turn transitions into a thicker backup or base portion. The variable thicknesses ensure the necessary deflection characteristics in the blade, while the thicker backup portion provides adequate structurally rigidity. However, the thin tip portion is the section of the blade that actually engages the ink roller and, given its thin dimension, wears away relatively quickly.

SUMMARY OF THE INVENTION

In accordance with one aspect of the invention, a printing press ink scraping blade is provided which comprises a base end adapted to be mounted to a printing press, and a working end extending from the base end. The working end includes a scraping tip for engagement with an ink roller. The working end is unitary with the base end and has a thickness greater than the base end.

In accordance with another aspect of the invention, a method of fabricating a printing press ink scraping blade is provided which comprises the steps of forming a blank from the deflectable material, creating a bevel into a working end of the blank, and removing material from a base end of the blade to create a unitary scraping blade having a thicker working end than base end.

In accordance with another aspect of the invention, a printing press is provided which comprises a frame adapted to carry a web of paper through the printing press, at least one cylinder adapted to imprint ink on the web, an ink train adapted to carry ink to the at least one cylinder, a scraping roller, and a scraping blade in contact with the scraping roller. The scraping blade has a working end and a base end. The working end is integral with, and thicker than, the base end.

In accordance with yet another aspect of the invention, an ink scraping blade is provided which comprises a back edge, a front edge, first and second side edges, a bottom surface, and a top surface. The front edge is beveled. The bottom surface is substantially planar. The top surface includes a working end portion proximate the front edge and a mounting end portion proximate the back edge. First and second side edges are thicker adjacent the working end portion than adjacent the mounting end portion. The ink scraping blade is manufactured from a unitary piece of material.

These and other aspects and features of the invention will become more apparent from the following detailed description when taken in conjunction with the accompanying drawings.

Figure 1:
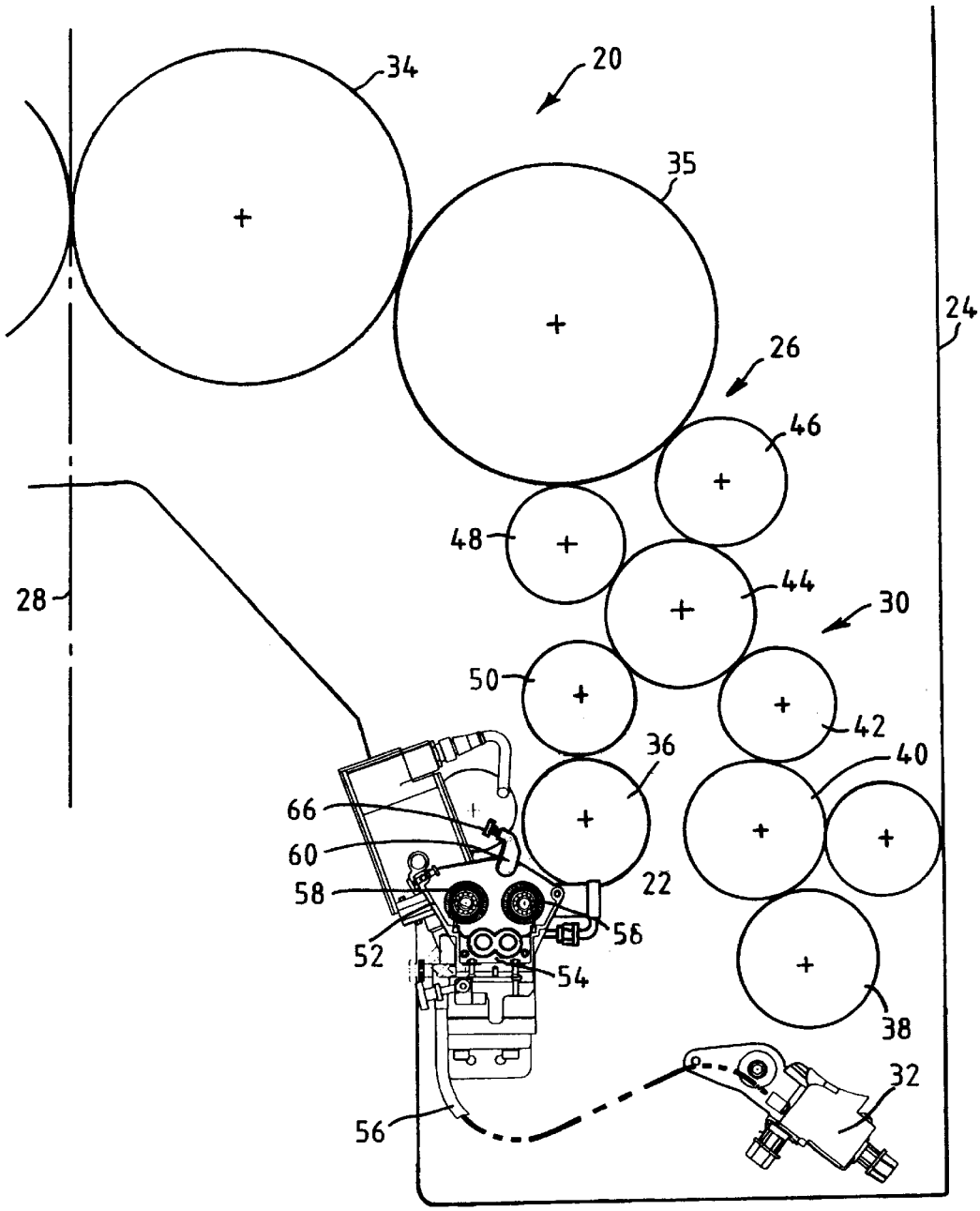
FIG. 1 is a side view of a printing press constructed in accordance with the teachings of the invention.

While the invention is susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

Referring now to the drawings, and with specific reference to FIG. 1, a printing press constructed in accordance with the teachings of the invention is generally depicted by reference numeral 20. It is to be understood that the teachings of the invention are primarily directed to the construction of a scraping blade 22. Accordingly, while the printing press 20 will be described in general terms herein, a complete description of a suitable printing press with which the scraping blade 22 can be operated is disclosed in many of the issued U.S. Patents of the assignee, some of which are U.S. Pat. Nos. 5,806,427; 5,868,071; and 5,943,955, each of which are herein incorporated by reference.

As shown briefly in FIG. 1, the printing press 20 includes a frame 24 to which a plurality of cylinders and rollers 26 are rotatably mounted for drawing a web 28 of paper therethrough under tension enabling images to be imprinted thereon. It will be noted that the press 20 is a of keyless design, in that the amount of ink transferred to the paper is not metered by a series of flow control valves or the like, but rather primarily relies upon the ink scraping blade 22 to accurately remove excess ink.

Also shown in FIG. 1 is an ink train 30 which directs ink from an applicator 32 to a blanket cylinder 34 and a plate cylinder 35 and back to a scraping roller 36 before removal by the scraping blade 22. It will be noted that the ink train 30 provides a substantially circular path, indicated by arrow 37 for the ink, as it transverses the ink train 30. As used herein, the term "ink train" is used to describe a series of rollers or other mechanisms used to carry ink to a cylinder for printing of a moving web, and transporting excess ink back for recycling. Moreover, while the drawings illustrate, and the following text describes, a printing press 20 having a plate cylinder 35 having the desired images thereon, and a blanket cylinder 34 to which ink in the desired image is transformed for application to the web 28, other configurations, such as those having a single cylinder for direct application to the web 28, are possible.

The applicator 32 of ink train 30, which can be provided in a plurality of forms including, but not limited to, ink rails and extrusion devices, directs ink to a first roller 38. Rotation of the first roller 38 directs the ink to a second roller 40 which in turn directs ink to a third roller 42, and ultimately to an apex roller 44. The ink from the apex roller 44 is directed in two directions. Primarily, the ink is directed from the apex roller 44 to fifth and sixth rollers 46, 48 and thereafter to the plate cylinder 35. The second direction in which the ink travels is via a return roller 50 which removes excess ink from the apex roller 44. It is to be understood that in alternative embodiments, only the fifth roller 46, or additional rollers, may be used to transfer ink to the plate cylinder 34.

From the return roller 50, ink is transferred to the scraping roller 36 where the ink is scraped therefrom by the scraping blade 22. Preferably, the scraping roller 36 is covered with hardened rubber, although other suitable materials, including many plastics and metals, are possible. Completing the ink train 30, it will be noted that an ink module 52 is provided below the ink roller 36. Ink removed by the scraping blade 22 falls via gravity into the module 52, whereupon it is directed by a pump 54 or series of pumps, through a hose or conduit 56 back to the applicator 32.

To facilitate removal of ink from the module 52, a pair of augers 58 are rotatably disposed within the hopper 52. Each of the augers 58 includes helical splines such that rotation of the augers 58 in opposite direction, causes the ink to be linearly traversed through the hopper 52 toward the pump 54. In alternative embodiments, more than or less than two augers 58 can be employed.

Figure 2:
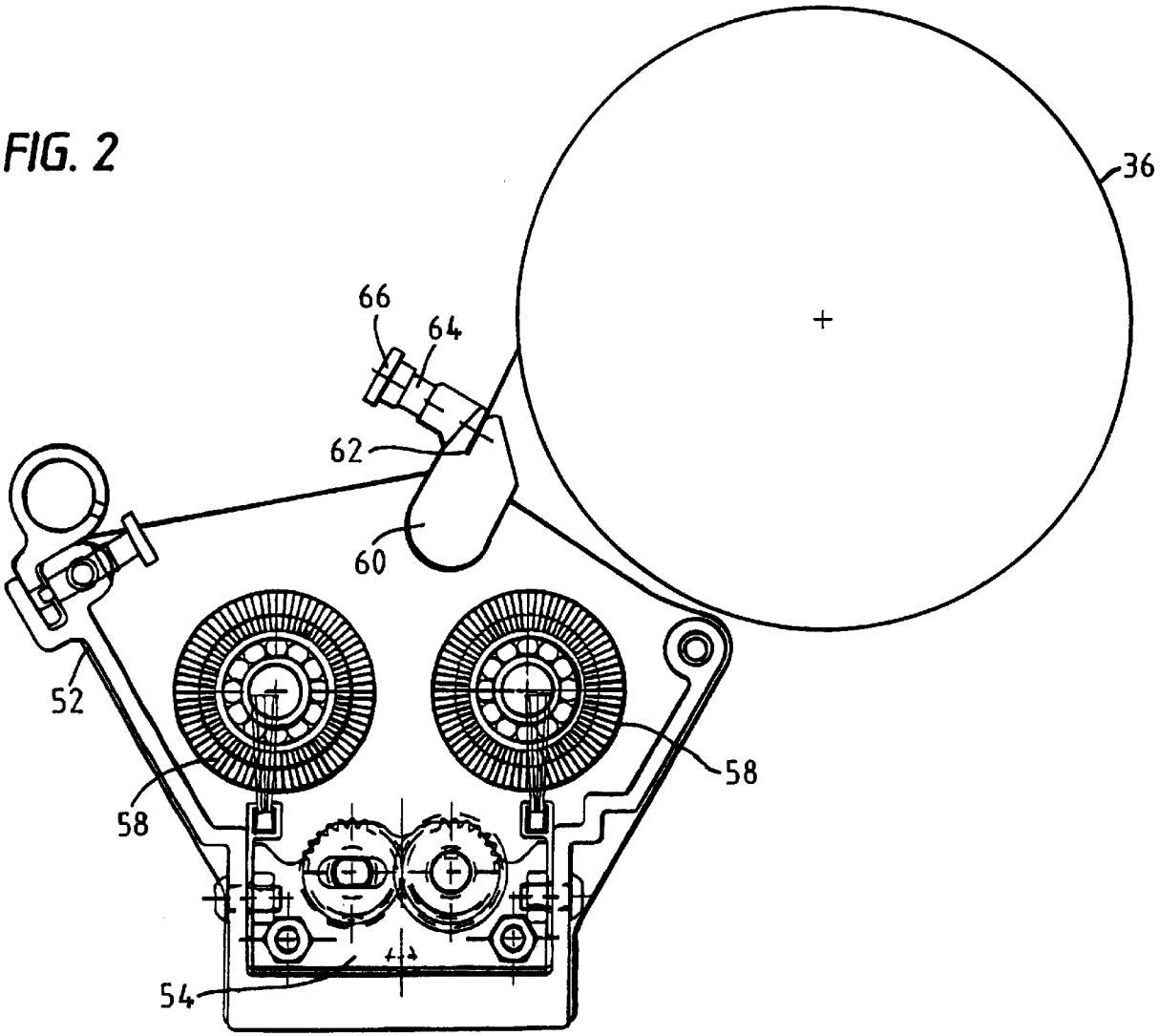
FIG. 2 is an enlarged side view of a scraping roller and scraping blade constructed in accordance with the teachings of the invention.

Also shown in FIG. 2 is a mounting bar 60 rotatably mounted within the module 52. The mounting bar 60 includes a slot or groove 62 into which the scraping blade 22 is inserted. As will be described in further detail herein, the scraping blade 22 includes at least one aperture which cooperates with a locking pin 64 of the mounting bar 60 to mount the blade 22 within the bar 60. Specifically, it will be noted that the locking pin 64 includes an user engageable handle 66 which is spring biased toward the slot 62. The user may pull the pin 64 away from the mounting bar 60 to remove the pin 64 from the slot 62 and allow the blade 22 to be removed. Upon release of the handle 66, the pin 64 is spring biased back across the slot 62 and through the scraping blade 22. In alternative embodiments, the blade 22 may be secured by other mechanisms including, but not limited to, threaded clamping devices and the like.

Preferably, the mounting bar 60 and scraping blade 22 are removably biased toward the scraping roller 36 to ensure adequate contact and removal of the ink. In the preferred embodiment, the mounting bar 60 is so biased by an air cylinder (not shown), but it is to be understood that in alternative embodiments, other biasing means including, but not limited to, springs, hydraulic cylinders and mechanical actuators are possible.

Figure 3:
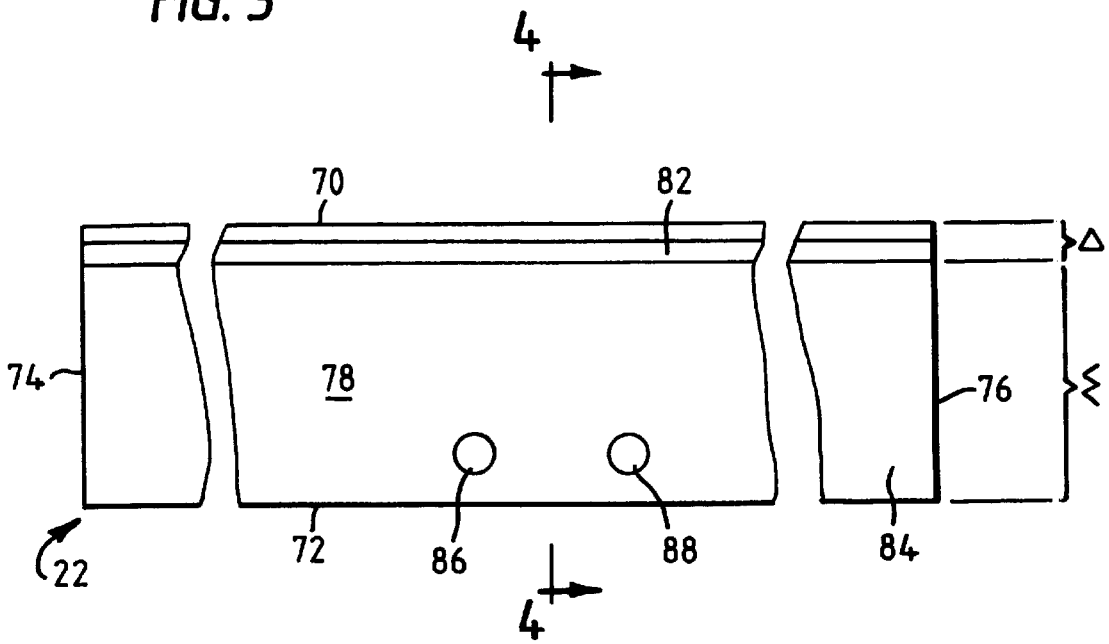
FIG. 3 is a plan view of a scraping blade constructed in accordance with the teachings of invention.
Figure 4:
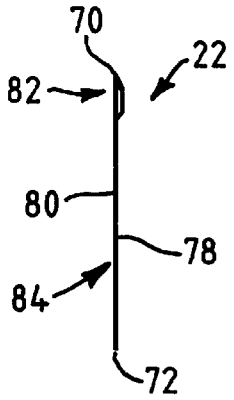
FIG. 4 is a cross sectional view of the scraping blade of FIG. 3 taken along line 4—4 of FIG. 3.

Referring now to FIGS. 3 and 4, the scraping blade 22 is shown in detail. As illustrated therein, the scraping blade 22 is primarily rectangular when viewed in two dimensions such as that depicted in FIGS. 3 and 4. The scraping blade 22 includes a front edge 70, a back edge 72, first and second side edges 74, 76, a top surface 78 and a bottom surface 80. The scraping blade 22 also includes two primary zones or ends. A working zone or end 82 is provided proximate the front edge 70, while a base or mounting end 84 is provided proximate the back edge 72. As shown best in FIG. 4, the working zone 82 is substantially shorter than the mounting zone 84. It is within the mounting zone 84, proximate the back edge 72, that first and second apertures 86, 88 are provided for cooperation with the locking pins 64 as described above.

Figure 5:
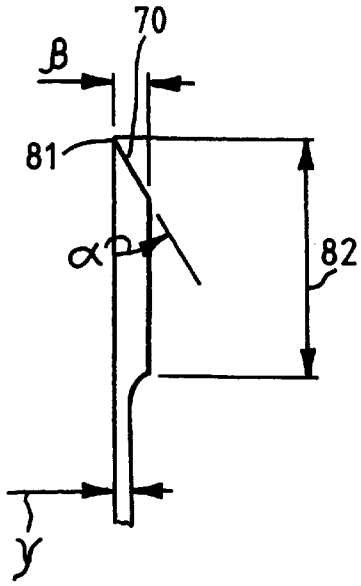
FIG. 5 is an enlarged sectional view of the working end of the scraping blade.

Referring now to FIG. 5, the working end 82 is depicted in further detail. It will be noted that the front edge 70 is beveled. Specifically, the front edge 70 is angled relative to the bottom surface 80 at an angle $\alpha$. This, among other things, ensures that the scraping blade 22 is able to remove, rather than simply push, the ink from the scraping roller 36. In the preferred embodiment, $\alpha$ is preferably within the range of approximately 15 degrees to approximately 45 degrees and, in the more preferred embodiment, is approximately 30 degrees. Other angles are certainly possible and encompassed within the scope of the invention. The bevel forms a tip 81 for engagement with the scraping roller 36. The tip 81, or the entire blade 22, may be coated with rust-proofing, such as chrome plating, oil based products.

It will also be noted from FIG. 5, that the working end 82 is substantially thicker than the mounting end 84. This, among other things, ensures that the scraping blade 22 has adequate deflection characteristics, while still providing a greatly enhanced serviceable life. More specifically, the working end 82 includes a thickness $\beta$ preferably within the range of approximately 0.02 inches to approximately 0.04 inches and, in a more preferred embodiment, is approximately 0.025 inches. It is to be understood that the thickness of the blade 22 can be any other dimension as well and encompassed within the scope of the invention.

With regard to the mounting end 84, its thickness $\gamma$ is preferably within the range of approximately 0.005 inches to approximately 0.015 inches and, more preferably 0.012 inches. Again, it is to be understood that the thickness of the mounting zone 84, can be any other dimension as well.

However, the inventor has found that the above dimensions are particularly advantageous, and that a ratio of β to γ of approximately 2.0 is desirable. Such dimensions and ratios are particularly applicable when the scraping blade 22 is manufactured from 1095 spring steel.

With further regard to dimensions, again referring to FIGS. 3 and 4, the working end 82 is shown to include a width Δ, while the mounting end 84 includes a width Σ. In the preferred embodiment, Σ is preferably within the range of approximately 0.1 inches to approximately 0.3 inches and, more preferably, is approximately 1.32 inches. Also in the preferred embodiment, Δ is preferably within the range of approximately 0.1 inches to 0.3 inches, and is more preferably 0.118 inches. It is to be understood, that in alternative embodiments, alternative dimensions can be employed with similar efficacy, but that a ratio of Δ to Σ being approximately 0.10 is preferable.

The scraping blade 22 may be constructed in a variety of manners. One preferred method involves a first step of stamping or otherwise forming a blank from a suitable material, such as the aforementioned 1095 spring steel. For example, a roll of spring steel having the desired width and a thickness corresponding to the desired thickness for the working end, may be stamped or cut into desired lengths. Alternatively, a rectangular dye having the desired dimensions may be directed, as by a hydraulic press or the like, toward a sheet of spring steel stock material to punch out or otherwise remove the blank from the sheet stock material. Such a blank preferably includes the desired thickness β for working end 82. The stamp may include punches for simultaneously forming the locking apertures 86, 88 as well, or such apertures may be separately formed.

The beveled tip 81 is then ground into the front edge 70 to the desired angle α indicated above. Such an operation may be performed as by a grinding wheel or the like. The blade 22 may be completed upon removing sufficient material from the mounting end 84 to reduce the mounting end 84 to the desired thickness γ indicated above. Again, such an operation may be performed by a grinding wheel or other abrasive tool. The grinding wheel should be selected to have a radius imparting an arcuate surface 90 to the blade 22 to transition from the working end 82 to the mounting end 84. This, among other things, tends to increase structural integrity of the blade 22. A preferred radius for the above-referenced dimensions is approximately 0.5 millimeters although other dimensions are certainly possible. Moreover, the inventor has found that the grinding process should remove the spring steel in small increments, on the order of 0.001 inches per pass of the grinding wheel. This also tends to maintain the structural integrity of the blade 22.

From the foregoing, it will be understood by one of ordinary skill in the art that the teachings of the invention can be employed to construct a scraping blade having improved deflection characteristics as well as an enhanced serviceable life. Specifically, the relatively thin nature of the working end of the blade ensures the blade is able to bend and deflect for contact with the ink roller especially when the blade is manufactured from spring steel, while the enhanced thickness of the working end and unitary construction of the working end with the base end ensure enhanced operation time of the blade prior to replacement.

What is claimed is:

1. A printing press ink scraping blade, comprising:

a base end adapted to be mounted to a printing press; and a working end extending from the base end, the working end including a scraping tip for engagement with a scraping roller, the working end being unitary with the base end and having a thickness greater than the base end, the printing press ink scraping blade being manufactured from only one unitary piece of material, the scraping tip extending from the working end in a direction substantially parallel to a longitudinal axis of the blade.

2. The printing press ink scraping blade of claim 1, wherein the base end and working end are manufactured from deflectable material.

3. The printing press ink scraping blade of claim 2, wherein the deflectable material is spring steel.

4. The printing press ink scraping blade of claim 1, wherein the working end further includes a front edge, the front edge being beveled.

5. The printing press ink scraping blade of claim 4, wherein the working end includes a top planar surface and a bottom planar surface, the top and bottom planar surfaces being parallel, the beveled edge extending from the bottom planar surface toward the top planar surface at an angle of approximately thirty degrees.

6. The printing press ink scraping blade of claim 1, wherein the working end has a thickness of β, and the base end has a thickness of γ, the ratio of β to γ being approximately 2.0.

7. The printing press ink scraping blade of claim 1, wherein the working end has a width Δ and the base end has a width Σ, the ratio of Δ to Σ being approximately 0.104.

8. A printing press ink scraping blade, comprising:

a base end adapted to be bound to a printing press;

a working end extending from the base end, the working end including a scraping tip for engagement with a scraping roller, the working end being unitary with the base end and having a thickness greater than the base end, the working end having a thickness of β, and the base end has a thickness of γ, the ration of β to γ being approximately 2.0, wherein β is 0.02 inches, and γ is 0.012 inches.

9. A printing press ink scraping blade, comprising:

a base end adapted to be mounted to a printing press; and a working end extending from the base end, including a scraping tip for engagement with a scraping roller, the working end being unitary with the base end and having a thickness greater than the base end, the working end having a width Δ and the base end having a width Σ, the ratio of Δ to Σ being approximately 0.104, wherein Σ is approximately 0.118 inches and Δ is approximately 1.132 inches.

10. A method of fabricating a printing press ink scraping blade, comprising:

forming a blank from deflectable material;

creating a beveled scraping tip in a working end of the blank; and removing material from a base end of the material thereby generating a unitary scraping blade having a thicker working end than base end, the printing press ink scraping blade being manufactured from only one unitary piece of material, the scraping tip extending from the working end in a direction substantially parallel to a longitudinal axis of the blade.

11. The method of claim 10, wherein the deflectable material is spring steel.

12. The method of claim 10, wherein the bevel forms an angle of approximately thirty degrees.

13. The method of claim 10, wherein the creating and removing steps are performed by grinding.

14. A method, of fabricating a printing press ink scraping blade, comprising:

forming a blank from deflectable materials;

creating a bevel in a working end of the blank;

removing material from a base end of the material thereby generating a unitary scraping blade having a thicker working end than base end, wherein the blank has an initial thickness of approximately 0.025 inches, and the removing step reduces the thickness to approximately 0.012 inches.

15. A printing press, comprising:

a frame adapted to carry a web of paper through the printing press;

at least one cylinder adapted to imprint ink on the web;

an ink train adapted to carry ink to the at least one cylinder, the ink train including a scraping roller; and a scraping blade in contact with the scraping roller, the scraping blade having a working end a base end and a scraping tip, the working end being integral with, and thicker than, the base end, the scraping blade being manufactured from only one unitary piece of material, the scraping tip extending from the working end in a direction substantially parallel to a longitudinal axis of the blade.

16. The printing press of claim 15, wherein the printing press further includes an ink module disposed relative to the scraping blade, the ink module being adapted to receive ink removed by the scraping blade.

17. The printing press of claim 16, further including at least one pump and an applicator, each pump being in communication with the ink module and the applicator, ink being recycled by each pump from the ink module to the applicator.

18. The printing press of claim 17, wherein the ink module further includes an auger adapted to transport ink toward the pump.

19. The printing press of claim 15, wherein the scraping blade is manufactured of spring steel.

20. The printing press of claim 15, wherein the scraping blade is mounted in a pivotable mounting bar, and wherein the scraping blade is biased into engagement with the scraping roller.

21. The printing press of claim 20, wherein the scraping blade is biased by an air cylinder.

22. The printing press of claim 20, wherein the scraping blade includes at least one aperture, and wherein the mounting bar includes at least one pin adapted to pass through the scraping blade aperture to secure the blade to the mounting bar.

23. An ink scraping blade, comprising:

a back edge;

a front edge, the front edge being beveled and forming a scraping tip;

first and second side edges;

a bottom surface, the bottom surface being substantially planar; and a top surface, the top surface having a working end portion proximate the front edge and a mounting end portion proximate the back edge, the first and second side edges being thicker adjacent the working end portion than adjacent the mounting end portion, the ink scraping blade being manufactured from a unitary piece of material, the ink scraping blade being manufacturing from only one unitary piece of material, the scraping tip extending from the working end in a direction substantially parallel to a longitudinal axis of the blade.

24. The ink scraping blade of claim 23, wherein the front edge meets the bottom edge at a bevel of approximately thirty degrees.

25. The ink scraping blade of claim 23, wherein the first and second side edges have a thickness within the range of approximately 0.018 inches to approximately 0.032 inches portion.

26. The ink scraping blade of claim 23, wherein the first and second side edges have a thickness $\beta$ proximate the working end portion and a thickness $\gamma$ proximate the mounting end portion, the ratio of $\beta$ to $\gamma$ being approximately 2.00.

27. The ink scraping blade of claim 23, wherein the blade is manufactured from a deflectable material.

28. The ink scraping blade of claim 27, wherein the deflectable material is 1095 spring steel.

* * * * *

UNITED STATES PATENT AND TRADEMARK OFFICE

CERTIFICATE OF CORRECTION

PATENT NO. : 6,546,861 B2
DATED : April 15, 2003
INVENTOR(S) : John W. Manser

It is certified that error appears in the above-identified patent and that said Letters Patent is hereby corrected as shown below:

Column 8,
Line 22, please replace "manufacturing" with -- manufactured --.

Signed and Sealed this

Twenty-second Day of July, 2003

JAMES E. ROGAN
*Director of the United States Patent and Trademark Office*